US010276314B2

(12) United States Patent
Minke et al.

(10) Patent No.: US 10,276,314 B2
(45) Date of Patent: Apr. 30, 2019

(54) SWITCHING AND PROTECTION DEVICE FOR HIGH-VOLTAGE WIRING SYSTEM

(71) Applicant: VOLKSWAGEN AG, Wolfsburg (DE)

(72) Inventors: Andreas Minke, Gifhorn (DE); Karsten Haupt, Neubrück (DE); Ernst-Dieter Wilkening, Braunschweig (DE); Hendrik-Christian Köpf, Braunschweig (DE)

(73) Assignee: Volkswagen AG (DE)

( * ) Notice: Subject to any disclaimer, the term of this patent is extended or adjusted under 35 U.S.C. 154(b) by 2 days.

(21) Appl. No.: 14/967,287

(22) Filed: Dec. 12, 2015

(65) Prior Publication Data

US 2016/0211087 A1 Jul. 21, 2016

(30) Foreign Application Priority Data

Jan. 15, 2015 (DE) ..... 10 2015 200 507

(51) Int. Cl.

| | |
|---|---|
| ***H01H 3/02*** | (2006.01) |
| ***H01H 1/14*** | (2006.01) |
| ***H01H 89/00*** | (2006.01) |
| ***H01H 21/16*** | (2006.01) |
| ***H01H 1/20*** | (2006.01) |
| ***H01H 9/10*** | (2006.01) |

(Continued)

(52) U.S. Cl.

CPC ..... *H01H 3/02* (2013.01); *H01H 1/14* (2013.01); *H01H 1/20* (2013.01); *H01H 9/102* (2013.01);

(Continued)

(58) Field of Classification Search

CPC ..... H01H 1/20; H01H 9/102; H01H 50/546; H01H 1/14; H01H 3/02; H01H 89/00;

(Continued)

(56) References Cited

U.S. PATENT DOCUMENTS

| | | | | |
|---|---|---|---|---|
| 1,536,355 A | | 5/1925 | Pritchett | |
| 2,186,813 A | * | 1/1940 | Adam | H01H 9/102 337/194 |

(Continued)

FOREIGN PATENT DOCUMENTS

| | | |
|---|---|---|
| DE | 202010009326 U1 | 10/2011 |
| DE | 202012013107 U1 | 10/2014 |

(Continued)

OTHER PUBLICATIONS

JP/2005-005243, English machine translation, dated Jan. 6, 2005.*
Search Report for European Patent Application No. 15194104.4; dated Jun. 21, 2016.

*Primary Examiner* — Anatoly Vortman
(74) *Attorney, Agent, or Firm* — Barnes & Thornburg LLP

(57) ABSTRACT

A switching and protection device for high-voltage onboard electrical systems having a DC-voltage switch and a fuse, wherein the DC-voltage switch includes a housing, at least two fixed contacts, and a bridge designed to be movable with respect to the fixed contacts, wherein the bridge is formed from an electric insulator, wherein two contacts are arranged on the bridge such that, during a movement of the bridge in the direction of the fixed contacts, the two contacts make contact with the fixed contacts, wherein the two contacts arranged on the bridge are electrically connected to each other via the fuse.

14 Claims, 2 Drawing Sheets

(51) Int. Cl.

| | |
|---|---|
| ***H01H 50/54*** | (2006.01) |
| *H01H 9/30* | (2006.01) |
| *H01H 9/32* | (2006.01) |
| *H01H 9/36* | (2006.01) |
| *H01H 9/46* | (2006.01) |
| *H01H 50/02* | (2006.01) |
| *H01H 85/02* | (2006.01) |

(52) U.S. Cl.
CPC ..... *H01H 21/165* (2013.01); *H01H 50/546* (2013.01); *H01H 89/00* (2013.01); *H01H 9/302* (2013.01); *H01H 9/32* (2013.01); *H01H 9/36* (2013.01); *H01H 9/46* (2013.01); *H01H 50/021* (2013.01); *H01H 85/0241* (2013.01); *H01H 2223/002* (2013.01)

(58) Field of Classification Search
CPC ..... H01H 9/302; H01H 9/32; H01H 9/36; H01H 9/46; H01H 2223/002; H01H 85/0241; H01H 50/021; H01H 21/165
USPC ..... 337/274
See application file for complete search history.

(56) References Cited

U.S. PATENT DOCUMENTS

| | | | | | |
|---|---|---|---|---|---|
| 2,834,855 | A * | 5/1958 | Carpenter | H01H 9/102 | 218/43 |
| 3,123,692 | A * | 3/1964 | Weber | H01H 9/104 | 337/149 |
| 4,292,616 | A * | 9/1981 | Andersen | H01H 23/105 | 337/143 |
| 4,556,874 | A * | 12/1985 | Becker | H01H 85/32 | 337/242 |
| 5,014,036 | A * | 5/1991 | Komoto | H01H 9/102 | 337/4 |
| 5,831,507 | A * | 11/1998 | Kasamatsu | H01H 9/10 | 337/299 |
| 6,154,117 | A * | 11/2000 | Sato | H01H 1/66 | 337/354 |
| 9,263,211 | B2 * | 2/2016 | Weinreich | H01H 21/16 | |
| 2002/0041944 | A1 | 4/2002 | Stavnes et al. | | |
| 2005/0189206 | A1 * | 9/2005 | Takeda | H01H 1/2016 | 200/400 |
| 2007/0109704 | A1 * | 5/2007 | Apfelbacher | H01H 9/102 | 361/93.1 |
| 2010/0301974 | A1 * | 12/2010 | Nakagawa | H01H 9/102 | 335/156 |
| 2013/0127583 | A1 | 5/2013 | Gautier et al. | | |
| 2015/0042441 | A1 * | 2/2015 | Weinreich | H01H 21/165 | 337/1 |

FOREIGN PATENT DOCUMENTS

| | | | |
|---|---|---|---|
| EP | 0828269 | A2 | 3/1998 |
| FR | 957119 | A | 2/1950 |
| JP | 2005005243 | | 1/2005 |
| JP | 2010277802 | A | 12/2010 |
| JP | 2013105751 | A | 5/2013 |

* cited by examiner

SWITCHING AND PROTECTION DEVICE FOR HIGH-VOLTAGE WIRING SYSTEM

PRIORITY CLAIM

This patent application claims priority to German Patent Application No. 10 2015 200 507.0, filed 15 Jan. 2015, the disclosure of which is incorporated herein by reference in its entirety.

SUMMARY

Illustrative embodiments relate to a switching and protection device for high-voltage onboard electrical systems, in particular for high-voltage onboard electrical systems in a motor vehicle.

BACKGROUND

Switching and protection devices for high-voltage onboard electrical systems are used to manage the nominal current and a potential temporary overcurrent of the high-voltage onboard electrical system. All poles of the high-voltage onboard electrical system may be disconnected via the switching device during each switch-off process. However, the protection device is used for disconnecting a high-voltage battery in the case of fault currents which are larger than the overcurrents. The protection devices are generally designed as fuses. The switching devices may be designed as DC-voltage switches, for example, a relay. In the case of disconnections of all poles, disclosed embodiments are also possible in which one switching device is designed as a relay and one switching device is designed as a power semiconductor.

The fuses generally used are hermetically sealed fuses having ceramic or plastic housings in which multiple fusible elements having defined narrow sections are connected in parallel. Optionally, the housings are also filled with an extinguishing medium, for example, sand.

In addition to the resulting non-negligible installation space for the fuses, the requirements in a high-voltage onboard electrical system for motor vehicles place high demands in particular with respect to the triggering characteristics. For example, the allowable overcurrents may be relatively high. In addition, due to the parallel connection, manufacturing-related component tolerances must be considered, thus increasing the break times to be achieved.

Disclosed embodiments provide a switching and protection device which requires less installation space.

BRIEF DESCRIPTION OF THE DRAWINGS

Disclosed embodiments are explained in greater detail below with reference to the drawings.

DETAILED DESCRIPTION OF THE DISCLOSED EMBODIMENTS

Figure 1:
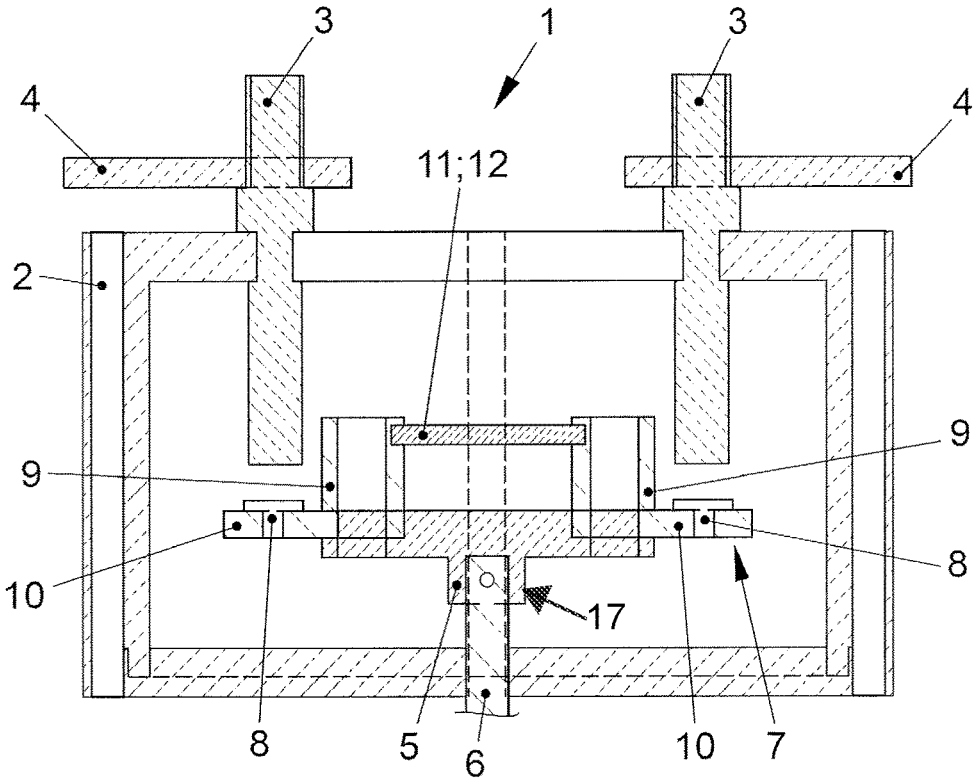
FIG. 1 shows a schematic sectional view of a switching and protection device in a first disclosed embodiment.

The switching and protection device for high-voltage onboard electrical systems comprises a DC-voltage switch and a fuse. The DC-voltage switch includes a housing, at least two fixed contacts, and a bridge, wherein the bridge is designed to be movable relative to the fixed contacts, wherein the bridge, for example, is moved against a spring with the aid of a rod. In this case, the housing may be designed in a hermetically sealed manner, i.e., a gas-tight manner. The bridge is formed from an electric insulator, wherein two contacts are arranged on the bridge which are arranged on the bridge in such a way that, during a movement of the bridge in the direction of the fixed contacts, the contacts make contact with the fixed contacts, wherein the two contacts on the bridge are connected to each other via the fuse. Due to this design, the fuse is integrated into the switching device, which results in a slight increase in the installation space of the switching device, which, however, results in overall decreased installation space due to the omission of the external fuse with its hermetic housing. The triggering characteristics of the integrated fuse may be more accurately adjusted, so that reduced break times are also achievable. Optionally, the contacts are screwed or molded or injected to the bridge.

In at least one disclosed embodiment, the fuse is designed as a wire which is arranged above the bridge between the contacts. For example, the wire is made of copper. If the wire is overloaded during a fault current flow, the wire vaporizes in an explosive manner. The pressure waves and changes in the conductivity of the wire or the resulting switching arc thus occurring due to the explosion process result in a voltage jump or an ignition peak of the arc voltage. If the jump or the ignition peak of the arc voltage exceeds the driving voltage, this results in an extinguishment of the switching arc in the case of ohmic loads or ohmic-inductive loads.

Alternatively, the fuse may also be formed on the bridge as a succession of conductor paths.

In an additional disclosed embodiment, the fuse is partially or completely embedded in the bridge. In this case, completely embedded means that the fuse is completely enclosed by the insulating material of the bridge (with the exception of the contacting points to the contacts). The embedding in the insulating material of the bridge thus allows a more compact design. Various additional measures are possible for ensuring the extinguishment of the switching arc.

In at least one disclosed embodiment, the bridge is made of a material which is strongly outgassing at the melting temperature of the fuse, optionally a material such as Plexiglas or polyoxymethylene. This results in a sharp pressure increase due to the gas formation, as well as a simultaneous cooling via the chemical decomposition processes in the switching device, which causes the triggering process.

Alternatively, the bridge may be made of a ceramic, or more generally, of a combustion-proof, electrically insulating, thermally conductive material. In this case, the basic idea is to remove thermal energy from the arc via the thermal conductivity of the material of the bridge, to cause it to extinguish.

In another disclosed embodiment, which may be used if the fuse is only partially embedded, electrically conductive guide rails are arranged in parallel with the fixed contacts, between which an insulator is arranged which has a gap opposite each of the guide rails. In this case, the basic principle is analogous to the strongly outgassing material. Due to the guide rail, the arc is forced into the narrow gap, where extends along it and strongly heats the insulator locally. Therefore, outgassing results, in which case the rising pressure results in an extinguishment of the arc.

In this case, conducting structures, optionally wedge-shaped structures, may be arranged on the bridge, which are formed in such a way that they direct the arc between the guide rail and the insulator to accelerate the extinguishment.

In a further disclosed embodiment, arc splitters are arranged above the bridge which may be arranged in parallel. Furthermore, the arc splitters may be made of brass or iron, which then form so-called magnetic arc splitter stacks. Due to the magnetization, they draw the arc between the splitters, which results in a series circuit made up of multiple arcs, which then force the current to be disconnected to zero due to the overall higher arc-burning voltage. In this case, the relatively cool arc splitters additionally remove heat energy from the arcs, which results in an increase in resistance of the arcs. This results in a more rapid extinguishment of the arcs.

In an additional disclosed embodiment, an insulator is arranged in such a way that it is moved between the contacts during the melting of the fuse, to interrupt the arc. In this case, the insulator may be wedge-shaped. The movement of the insulator may, for example, be triggered with the aid of a pyrotechnic propellant. Alternatively, a pre-stressed spring may be used, which is released during the melting of the fuse.

FIG. 1 depicts a switching and protection device 1 in a first disclosed embodiment. The switching and protection device 1 includes a hermetic housing 2, out of which two fixed contacts 3 are routed. HV lines 4 may then be connected to the fixed contacts 3, which then, for example, connect the switching and protection device 1 to an HV battery, which is not depicted, and to an intermediate circuit. Furthermore, the switching and protection device 1 includes a bridge 5 which is made of an electric insulator. The bridge 5 includes a receiver 17 connected to a rod 6 which is routed downward out of the housing 2. The rod 6 is upwardly movable against a spring or a similar actuator via a magnetic force. The bridge 5 is connected to two contact elements 7. Each of the contact elements 7 has a contact 8 and a hollow cylinder (or post) 9 which are connected to each other via a base (or extension) element 10. A fuse 12, for example, a wire 11, is electrically conductively arranged between the hollow cylinders 9. The connection between the wire 11 and the hollow cylinder 9 may, for example, be a clamp or screw connection. Other attachment types are possible, wherein the attachment must be thermally stable. The contact element 7 is then screwed to the bridge via the hollow cylinder 9. The connection between the contact element 7 and the bridge 5 may also be established via alternative attachment methods. In this case, the hollow cylinder 9 may then also be replaced by a different element for accommodating the wire 11. The hollow cylinder 9 and the base element 10 may be one piece. In the depicted exemplary embodiment, the contact 8 is inserted into the base element 10 as a separate part; however, it may also be designed integrally with the base element. The contact 8 is matched to the shape and position of the fixed contacts 3.

The wire 11 is sized in such a way that it is able to carry the nominal current as well as the operation-related overcurrent; however, in the case of fault currents greater than a threshold value above the overcurrents, it vaporizes in an explosive manner. In this case, the triggering characteristics of the wire 11 may be adjusted very easily in comparison to the related art, so that the triggering may occur more rapidly and more reliably. During regular operation, for example, a coil (not shown) associated with the rod 6 is supplied with current, and the rod 6 is moved upward against a spring force due to a magnetic force. If the contacts 8 and the fixed contacts 3 then touch, the electrical connection is established between the fixed contacts 3. If a fault current then results, the wire 11 vaporizes, wherein a resulting arc is extinguished with the aid of the increase in pressure due to the explosive vaporization. In this case, the contacts 8 and the fixed contacts 3 may remain in contact so as not to form another arc.

Figure 2:
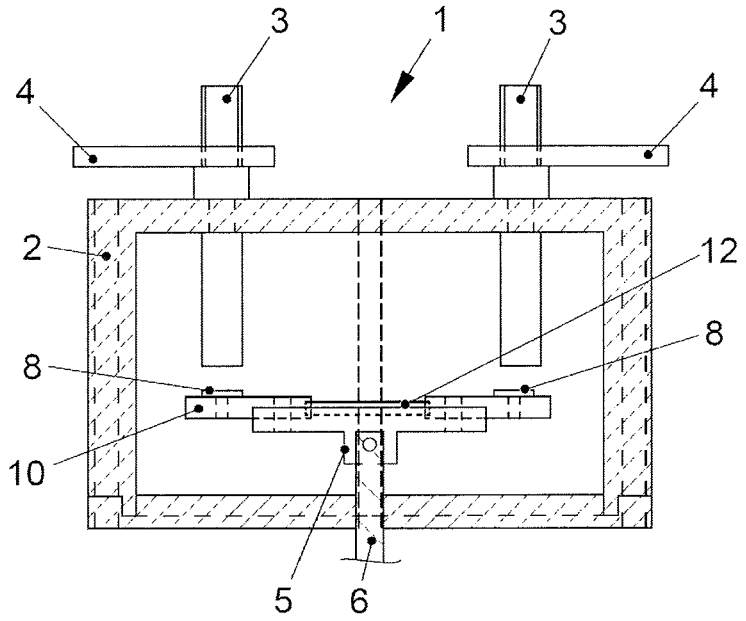
FIG. 2 shows a schematic sectional view of a switching and protection device in a second disclosed embodiment.

FIG. 2 shows an alternative disclosed embodiment of the switching and protection device 1, wherein identical elements are provided with identical reference numerals. It is to be noted that the cross-section was applied differently in comparison to FIG. 1.

The contact element 7 again includes a contact 8 and base element 10 which, for example, are riveted or soldered to each other, as indicated by the dashed lines. Alternatively, they may be formed in one piece, or the contact 8 is inserted into the base element 10. The base element 10 may be screwed to the bridge 5, as also indicated by the dashed lines. The fuse 12, which is partially embedded in the bridge 5 (also indicated by dashed lines), is situated between the two base elements 10. The connection between the fuse 12 and the base elements 10 is, for example, a plug connection. The bridge 5 may be made of a strongly outgassing material, for example, Plexiglas or POM (polyoxymethylene).

In the case of a fault current, the fuse 12 melts, wherein the bridge 5 also outgasses due to the generated heat. This results in a pressure increase in the hermetic housing 2, so that an arc occurring between the base elements 10 is extinguished.

Figure 3:
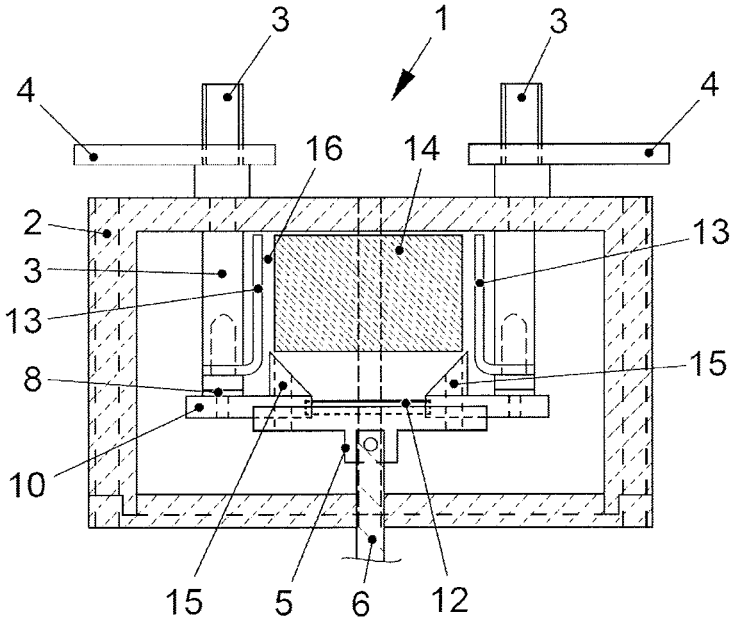
FIG. 3 shows a schematic sectional view of a switching and protection device in a third disclosed embodiment.

FIG. 3 depicts an additional disclosed embodiment of the switching and protection device 1, wherein identical elements are again provided with identical reference numerals. In this case, the switching device is depicted in the closed state, i.e., the contacts 8 make contact with the fixed contacts 3. In addition to FIG. 2, the switching and protection device 1 includes two guide rails 13, each running in parallel with the fixed contacts 3 and being screwed to them.

An insulator 14 is arranged between the guide rails 13 which has a gap on each of the sides opposite the guide rails 13. The gap runs in parallel with the guide rails 13. The insulator 14 is made of a strongly gassing material such as Plexiglas or POM. The insulator 14 is, for example, screwed to the housing 2. Two conducting structures 15 are furthermore arranged at the base elements 10, between which the fuse 12 extends. The conducting structures 15 are wedge-shaped and are, for example, screwed to the base elements 10. As a result, an arc occurring during the melting of the fuse 12 is routed via the conducting structure 15 into a channel 16 between the guide rail 13 and the insulator 14 having the gap. The arc running in the narrow gap heats the insulator 14, which then begins to outgas. The resulting pressure increase causes the arc to extinguish.

Switching and protection devices for high-voltage onboard electrical systems are used to manage the nominal current and a potential temporary overcurrent of the high-voltage onboard electrical system. All poles of the high-voltage onboard electrical system may be disconnected via the switching device during each switch-off process. However, the protection device is used for disconnecting a high-voltage battery in the case of fault currents which are larger than the overcurrents. The protection devices are generally designed as fuses. The switching devices may be designed as DC-voltage switches, for example, a relay. In the case of disconnections of all poles, disclosed embodiments are also possible in which one switching device is designed as a relay and one switching device is designed as a power semiconductor.

The fuses generally used are hermetically sealed fuses having ceramic or plastic housings in which multiple fusible elements having defined narrow sections are connected in parallel. Optionally, the housings are also filled with an extinguishing medium, for example, sand.

In addition to the resulting non-negligible installation space for the fuses, the requirements in a high-voltage onboard electrical system for motor vehicles place high demands in particular with respect to the triggering characteristics. For example, the allowable overcurrents may be relatively high. In addition, due to the parallel connection, manufacturing-related component tolerances must be considered, thus increasing the break times to be achieved.

DE 20 2012 013 107 U1 discloses an arc extinguishing device for an electric installation switching device, wherein the installation switching device comprises a contact point formed from a fixed and a movable contract piece. In this case, the arc extinguishing device comprises an arc splitter stack including multiple arc splitter plates.

The invention claimed is:

1. A switching and protection device for high-voltage onboard electrical systems, the device comprising:

a DC-voltage switch; and a fuse, wherein the DC-voltage switch includes a hermetically sealed housing, at least two fixed contacts penetrating from outside to inside of the hermetically sealed housing, and a bridge designed to be movable with respect to the fixed contacts, and wherein the bridge is formed from an electric insulator, wherein two bridge contacts are arranged on the bridge so that, during a movement of the bridge in the direction of the fixed contacts, the two bridge contacts make contact with the fixed contacts, wherein the two bridge contacts arranged on the bridge are electrically connected to each other via the fuse, wherein each of the bridge contacts includes a base extending from the bridge in a lateral direction and the fuse arranged farther from the base than the corresponding bridge contact orthogonal to the lateral direction.

2. The switching and protection device of claim 1, wherein the fuse is a wire which is arranged above the bridge between the two bridge contacts.

3. The switching and protection device of claim 1, wherein the bridge is made of a material which is outgassing at the melting temperature of the fuse.

4. The switching and protection device of claim 3, wherein the bridge is made of Plexiglas or polyoxymethylene.

5. The switching and protection device of claim 1, wherein the bridge is made of a ceramic.

6. The switching and protection device of claim 1, wherein the fuse is arranged spaced apart from the bridge contacts along a direction of movement of the bridge.

7. The switching and protection device of claim 1, wherein the bridge includes a number of posts projecting therefrom in the direction of the fixed contacts, the fuse extends between the posts, at a position offset from the two bridge contacts towards the fixed contacts.

8. The switching and protection device of claim 7, wherein the bridge extends between the fixed contacts and includes an extension element projecting from either end, each extension element carrying one of the two bridge contacts and being electrically connected with the posts.

9. The switching and protection device of claim 8, wherein the number of posts are each cylindrical posts.

10. A switching and protection device for high-voltage onboard electrical systems, the device comprising:

a DC-voltage switch; and a fuse, wherein the DC-voltage switch includes a hermetically sealed housing, at least two fixed contacts, a bridge designed to be movable with respect to the fixed contacts, and a connection rod attached with the bridge, the bridge having a T-shape including a receiver attached with the connection rod, wherein the bridge is formed from an electric insulator, wherein two bridge contacts are arranged on the bridge so that, during a movement of the bridge in the direction of the fixed contacts, the two bridge contacts make contact with the fixed contacts, wherein the two bridge contacts arranged on the bridge are electrically connected to each other via the fuse.

11. The switching and protection device of claim 1, wherein each fixed contact is connected with a high voltage line outside of the hermetically sealed housing.

12. The switching and protection device of claim 1, wherein the bridge is positionable in a first position in which the contacts of the bridge do not contact the fixed contacts and a second position in which the bridge contacts do contact the fixed contacts.

13. A device for high-voltage onboard electrical systems, the device comprising:

a DC-voltage switch; and a fuse wire, wherein the DC-voltage switch includes a hermetically sealed housing, at least two fixed contacts, a bridge formed from an electrical insulator and movable with respect to the fixed contacts, and a connection rod attached with the bridge, the bridge having a T-shape for attachment with the connection rod, wherein the bridge includes bridge contacts arranged thereon electrically connected with each other via the fuse wire, the bridge contacts arranged so that, during a movement of the bridge in the direction of the fixed contacts, the bridge contacts engage with the fixed contacts to provide electrical communication via the fuse wire.

14. A switching and protection device for high-voltage onboard electrical systems, the device comprising:

a DC-voltage switch; and a fuse, wherein the DC-voltage switch includes a hermetically sealed housing, at least two fixed contacts, and a bridge designed to be movable with respect to the fixed contacts, and wherein the bridge is formed from an electric insulator, wherein two bridge contacts are arranged on the bridge so that, during a movement of the bridge in the direction of the fixed contacts, the two bridge contacts make contact with the fixed contacts, wherein the two bridge contacts arranged on the bridge are electrically connected to each other via the fuse, wherein the bridge includes a number of posts projecting therefrom in the direction of the fixed contacts, the two bridge contacts arranged spaced apart from the posts orthogonal to the direction of projection of the posts.

* * * * *